US005394574A

United States Patent [19]

Chuang

[11] Patent Number: 5,394,574

[45] Date of Patent: Mar. 7, 1995

[54] FOLDABLE BED FOR INFANTS

[76] Inventor: James Chuang, 58, Ma Yuan West St., Taichung, Taiwan, Prov. of China

[21] Appl. No.: 172,900

[22] Filed: Dec. 27, 1993

[51] Int. Cl.[6] ..... A47D 7/00

[52] U.S. Cl. ..... 5/99.1; 5/11; 5/282.1

[58] Field of Search ..... 5/99.1, 98.1, 98.2, 5/98.3, 282.1, 11, 611, 93.1

[56] References Cited

U.S. PATENT DOCUMENTS 1,043,728 11/1912 Robison ..... 5/11
2,242,307 5/1941 Kroll ..... 5/11
3,092,847 6/1963 De Puy ..... 5/99.1
3,162,865 12/1964 Tigrett ..... 5/99.1
3,165,760 1/1965 Abajian ..... 5/98.1

*Primary Examiner*—Flemming Saether

[57] ABSTRACT

A foldable bed includes four posts each having two or more holes, a block slidably engaged on each of the posts, four rods coupled between the blocks and the blocks, a disc slidably received in each of the blocks, a shaft extended through each of the discs and having one end engagable with the holes of the posts, a spring for biasing the shafts to engage with the holes of the posts, a spindle is disposed in the coupler and four cables are coupled between the shafts and the spindle, the shafts are disengaged from the holes when the spindle is rotated such that the blocks can be easily adjusted upward and downward along the posts.

3 Claims, 3 Drawing Sheets

FIG. 2 Z—Z

FOLDABLE BED FOR INFANTS

BACKGROUND OF THE INVENTION

1. Field of the Invention

The present invention relates to a bed, and more particularly to a foldable bed for infants.

2. Description of the Prior Art

Typical foldable beds for infants comprise an upper frame, a lower frame and a number of posts coupled between the frames. However, the lower frame may not be adjusted upward or downward in order to adjust the height of the base of the bed.

The present invention has arisen to mitigate and/or obviate the afore-described disadvantages of the conventional foldable beds for infants.

SUMMARY OF THE INVENTION

The primary objective of the present invention is to provide a foldable bed for infants in which the base portion of the bed can be adjusted upward and downward in order to adjust the height of the base of the bed.

In accordance with one aspect of the invention, there is provided a foldable bed comprising an upper frame including four first bars each having a first joint provided in a middle portion and having end portions coupled together by four second joints, a lower frame including four beams each having a third joint provided in a middle portion and having end portions coupled together by four fourth joints, four posts coupled between the second joints and the fourth joints, each of the posts including at least two holes formed therein, a block slidably engaged on each of the posts, a coupler, four rods each having a first end coupled together at the coupler and having a second end coupled to a respective block, a room formed in a middle portion of each of the blocks, a disc slidably received in each of the rooms, a shaft extended through each of the discs and having a first end engagable with the holes of the posts and having a second end extended toward the rods, means for biasing the shafts to engage with the holes of the posts, the coupler including a depression formed in a middle portion thereof, a knob including a spindle rotatably received in the depression of the coupler, and four cables each having a first end coupled to a respective shaft and a second end coupled to the spindle, the shafts being pulled and disengaged from the holes of the posts when the knob is rotated and when the cables are wound on the spindle, and the shafts being biased to engage with the holes by the biasing means when the knob is released, whereby, the blocks are allowed to adjust upward and downward along the posts.

Further objectives and advantages of the present invention will become apparent from a careful reading the detailed description provided hereinbelow, with appropriate reference to the accompanying drawings.

DETAILED DESCRIPTION OF THE PREFERRED EMBODIMENT

Figure 1:
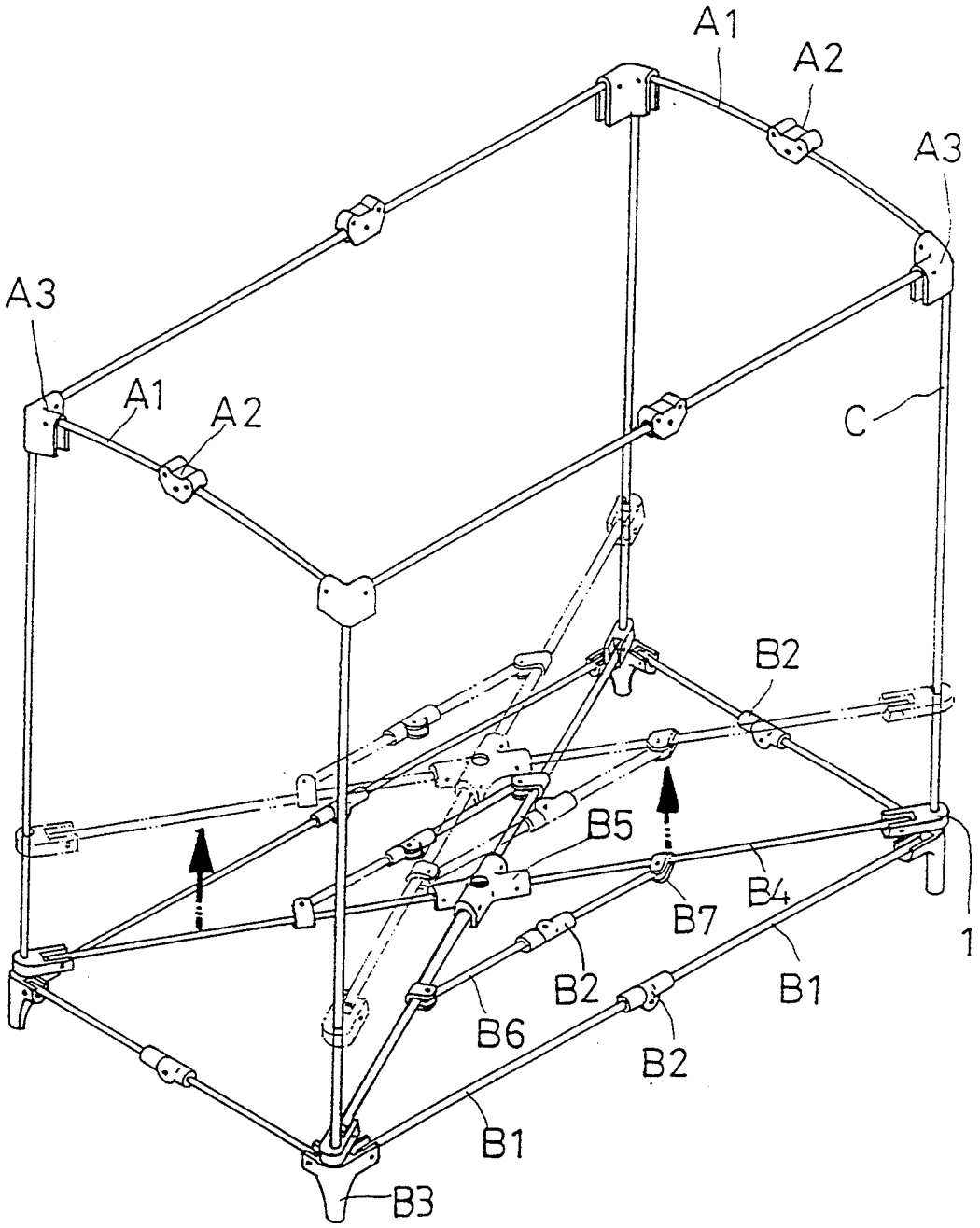
FIG. 1 is a perspective view of a foldable bed in accordance with the present invention.

Referring to the drawings, and initially to FIG. 1, a foldable bed in accordance with the present invention also comprises an upper frame including four bars A1 each having a joint A2 provided in the middle portion and having the end portions coupled together by four joints A3, a lower frame including four beams B1 each having a joint B2 provided in the middle portion and having the end portions coupled together by four joints B3, and four posts C coupled between the joints A3 and B3, four rods B4 each having one end coupled together at a coupler B5 and having the other end coupled to a block 1 which is slidably engaged to the respective posts C and movable up and down along the posts C, two poles B6 coupled to the rods B4 by joints B7 and each having a joint B2 provided in the middle portion thereof.

Figure 2:
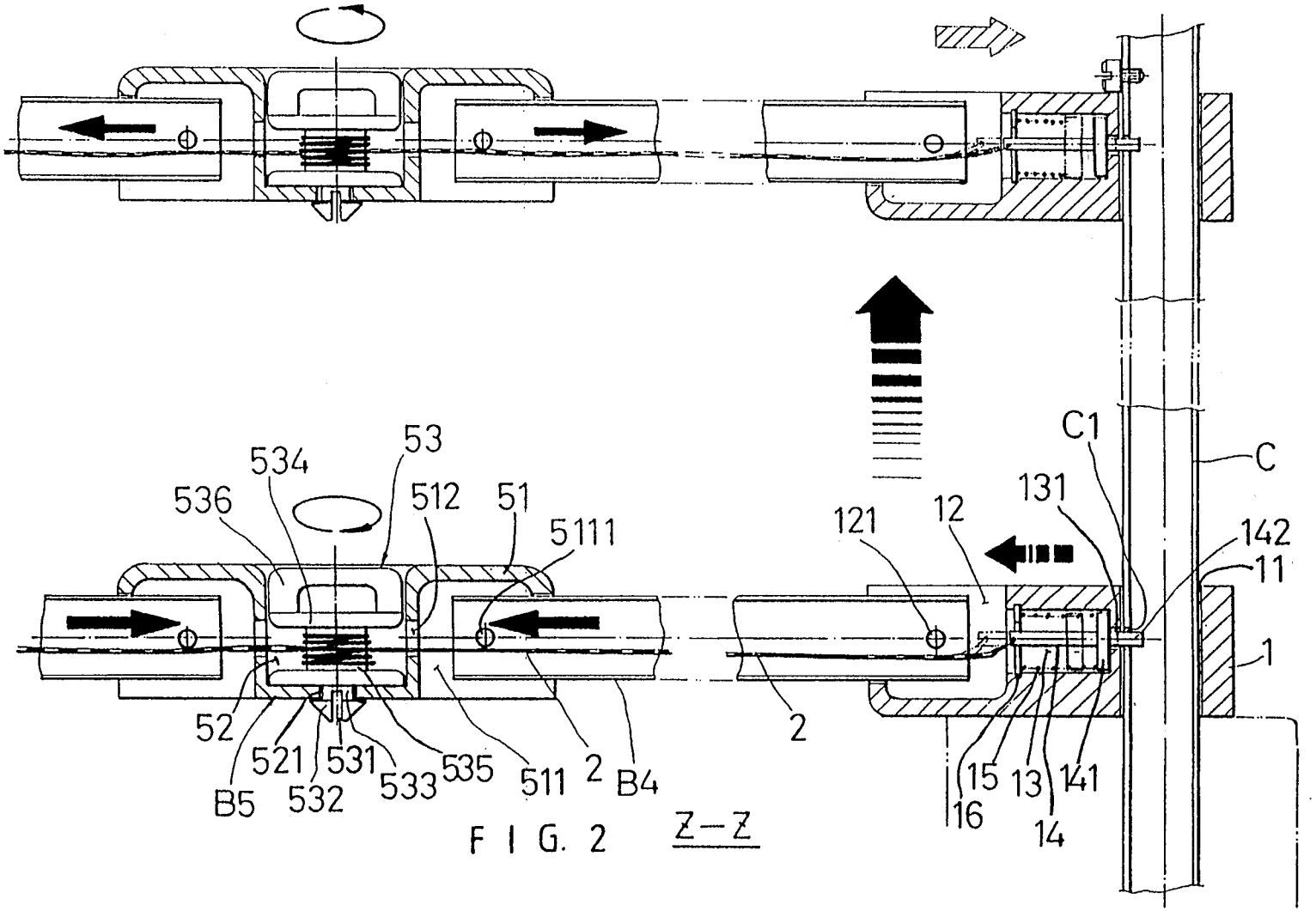
FIG. 2 is a partial cross sectional view of one of the joints of the foldable bed, taken along the lines Z—Z of FIG. 3.
Figure 3:
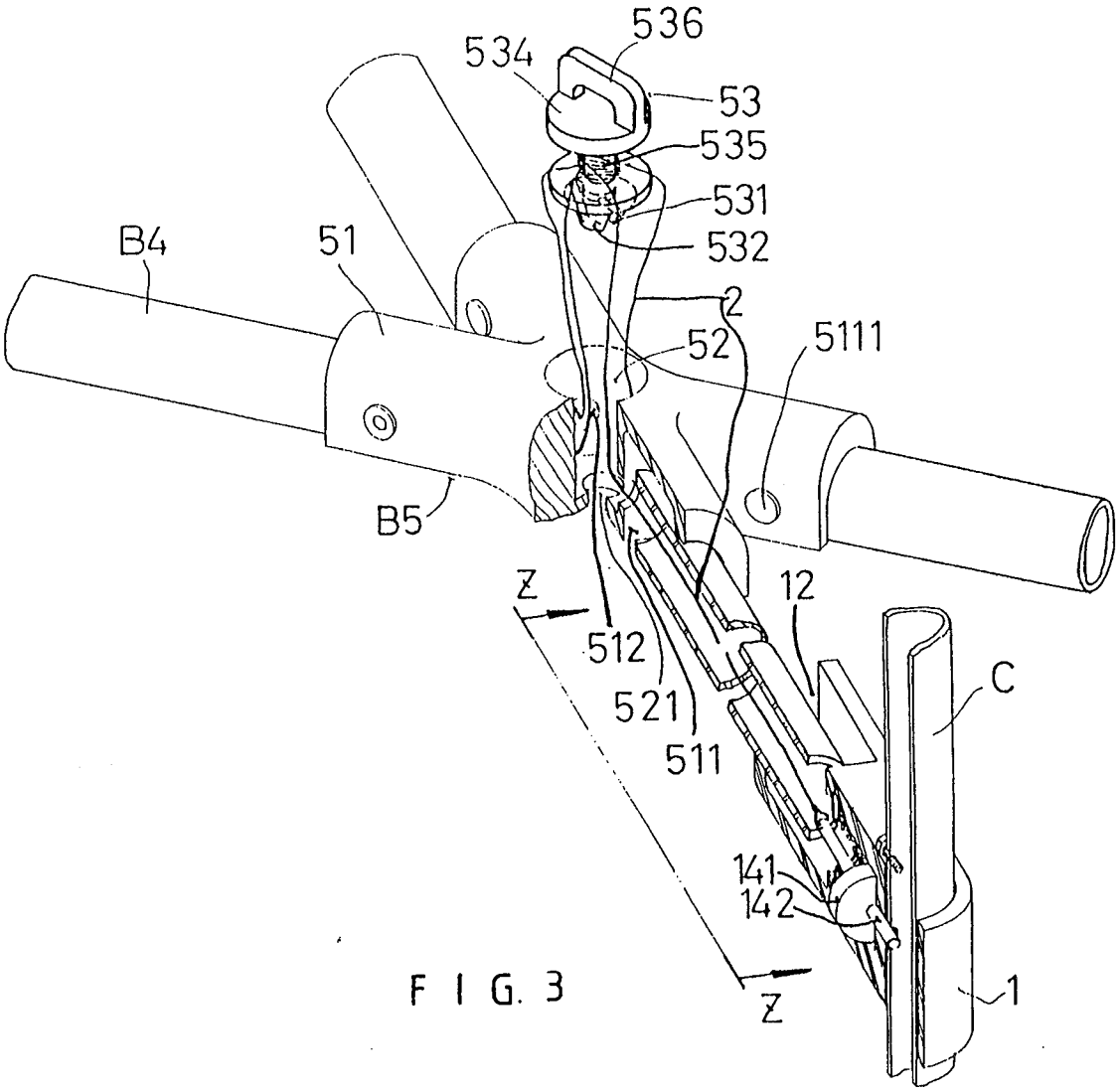
FIG. 3 is a perspective and partial cross sectional view illustrating one of the joints as shown in FIG. 2.

Referring next to FIGS. 2 and 3, each of the posts C includes a number of holes C1 formed in the lower portion thereof, each of the blocks 1 includes an aperture 11 for engaging with the post C and an opening 12 for receiving the end portion of the rod B4, the rods B4 are coupled to the blocks 1 by pivot pin 121, a room 13 formed in the middle portion of each of the blocks 1 and located between the aperture 11 and the opening 12, an orifice 131 formed and communicated between the room 13 and the aperture 11, a catch 14 including a disc 141 slidably received in each of the rooms 13 and a shaft 142 extended through the disc 141 and having one end engagable with the holes C1 of the posts C, a ring 16 fixed in each of the rooms 13, a spring biased between the disc 141 and the ring 16 for biasing the shaft 14 to engage with the holes C1.

The coupler B5 includes four stubs 51 extended outward therefrom and each having a space 511 formed therein for receiving the end portions of the rods B4 which are pivotally coupled to the coupler by pivot pins 511I, a depression 52 is formed in the middle portion of the coupler B5, and four passages 512 are formed in the coupler B5 and communicated with the respective spaces 511, an access 521 formed in the bottom portion of the depression 52, a knob 53 is received in the depression 52 and includes a head 532 having a slot 531 formed therein such that the head 532 may be engaged through the access 521, and the knob 53 includes an axle 533 rotatably engaged in the access 521, the knob 53 further includes a spindle 535 having two annular flanges 534 formed in the upper and lower portion thereof respectively, a handle 536 provided in top of the knob 53 for pulling the knob 53 upward away from the depression 52, and four cables 2 each having one end coupled to the respective shafts 142 and the other end coupled to the spindle 535.

In operation, the handle 536 of the knob 53 is rotated such that the cables 2 can be wound on the spindle 535 and such that the shafts 142 can be pulled and disengaged from the holes C1 of the posts C, at this moment, the blocks 1 are unlocked and can be moved either upward or downward along the posts C, the shafts 142 can be biased to engage with the holes C1 when the shafts 142 are aligned with the other holes C1 and when the knob 53 is released, such that the height of the base portion of the bed can be easily adjusted upward or downward.

Accordingly, the foldable bed in accordance with the present invention includes a base portion of the bed can be easily adjusted upward or downward.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable bed comprising an upper frame including four first bars each having a first joint provided in a middle portion and having end portions coupled together by four second joints, a lower frame including four beams each having a third joint provided in a middle portion and having end portions coupled together by four fourth joints, four posts coupled between said second joints and said fourth joints, each of said posts including at least two holes formed therein, a block slidably engaged on each of said posts, a coupler, four rods each having a first end coupled together at said coupler and having a second end coupled to a respective block, a room formed in a middle portion of each of said blocks, a disc slidably received in each of said rooms, a shaft extended through each of said discs and having a first end engagable with said holes of said posts and having a second end extended toward said rods, means for biasing said shafts to engage with said holes of said posts, said coupler including a depression formed in a middle portion thereof, a knob including a spindle rotatably received in said depression of said coupler, and four cables each having a first end coupled to a respective shaft and a second end coupled to said spindle, said shafts being pulled and disengaged from said holes of said posts when said knob is rotated and when said cables are wound on said spindle, and said shafts being biased to engage with said holes by said biasing means when said knob is released, whereby, said blocks are allowed to adjust upward and downward along said posts.

2. A foldable bed according to claim 1, wherein said coupler includes an access formed in a bottom portion of said depression, said knob includes a head engaged through said access and rotatably engaged in said access, and a handle provided in top of said knob for rotating said knob.

3. A foldable bed according to claim 1, wherein each of said blocks includes a ring fixed in said room thereof, and said biasing means is biased between said ring and said disc.

* * * * *